United States Patent [19]

Scott

[11] Patent Number: 4,800,089

[45] Date of Patent: Jan. 24, 1989

[54] PACKET WITH INTERNAL FILTER FOR COFFEE MACHINES

[76] Inventor: George W. Scott, 5701 San Vincente Blvd., Los Angeles, Calif. 90019

[21] Appl. No.: 167,650

[22] Filed: Mar. 14, 1988

[51] Int. Cl.[4] ..... B65B 29/02; A23F 5/46; A47J 31/06

[52] U.S. Cl. ..... 426/78; 99/295; 426/77; 426/96; 426/111; 426/595; 426/650

[58] Field of Search ..... 426/77–84, 426/111, 96; 229/DIG. 3, 101; 99/295, 306; 383/120; 206/0.5

[56] References Cited

U.S. PATENT DOCUMENTS

| | | | |
|---|---|---|---|
| 1,324,662 | 12/1919 | Goldsworthy | 426/77 |
| 2,292,101 | 8/1942 | Brown | 426/77 |
| 3,083,100 | 3/1963 | Baran | 426/77 |
| 3,083,101 | 3/1963 | Noury | 426/77 |
| 3,309,005 | 3/1967 | Pilger | 229/101 |
| 3,445,237 | 5/1969 | Gidge | 426/77 |
| 3,446,624 | 5/1969 | Luedtke | 426/77 |
| 3,615,708 | 10/1971 | Abile-Gal | 426/77 |
| 3,914,439 | 10/1975 | Graves | 426/78 |
| 3,971,305 | 7/1976 | Daswick | 426/77 |
| 3,985,069 | 10/1976 | Cavalluzzi | 426/77 |
| 4,656,932 | 4/1987 | Kopp | 99/295 |
| 4,735,719 | 4/1988 | Benedict | 99/295 |

*Primary Examiner*—Steven Weinstein
*Attorney, Agent, or Firm*—Gilbert Kivenson

[57] ABSTRACT

A packet containing a measured amount of coffee solids within a housing which acts as filter is described. The unit allows more efficient loading of high output coffee machines and facilitates cleanup. An optical feature is the provision of timed release flavoring.

3 Claims, 1 Drawing Sheet

PACKET WITH INTERNAL FILTER FOR COFFEE MACHINES

BACKGROUND

Coffee brewing apparatus in restaurants is furnished in two general capacities: a twelve cup size for the average establishment and a larger capacity size for restaurants having several dining rooms. It is found that the beverage tastes fresher if prepared in small volumes which are renewed as the coffee is consumed.

To facilitate the brewing process the ground coffee is provided in premeasured, sealed packets each holding enough for one cycle of the smaller machines. The restaurant employee pulls open a charging receptacle, adds a paper filter and pours ground coffee from a freshly opened packet over the filter. He then closes the receptacle and starts a cycle. Subsequent cycles are identical except that the used charge from the previous cycle must first be emptied. In the case of the larger machines the packet contains more solids but the coffee is still drawn off in twelve cup quantities which are kept hot on warmers in the various dining rooms.

The present invention relates to sealed coffee packets which incorporate a filter. The user needs only to add the improved packet to a machine's receptacle, break the seal, close the receptacle and initiate a cycle of brewing. An optional feature of the present invention is the addition of flavoring such as chocolate, mint, lemon, etc. to the ground coffee in the larger sizes of the packet. The direct addition of flavoring to ground coffee would be unsatisfactory because of differences in the rate of solution of the flavoring material and the rate of coffee extraction from the ground solids. In the present invention the flavoring is added in the form of timed-release particles so that the rate of flavoring is adjusted to the rate of brewing. This and other features of the invention will be detailed in the following specifications and drawings.

DESCRIPTION OF THE INVENTION

Figure 1:
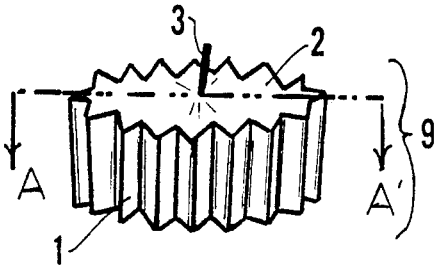
FIG. 1 is a perspective view of a packet made in accordance with the present invention.
Figure 2:
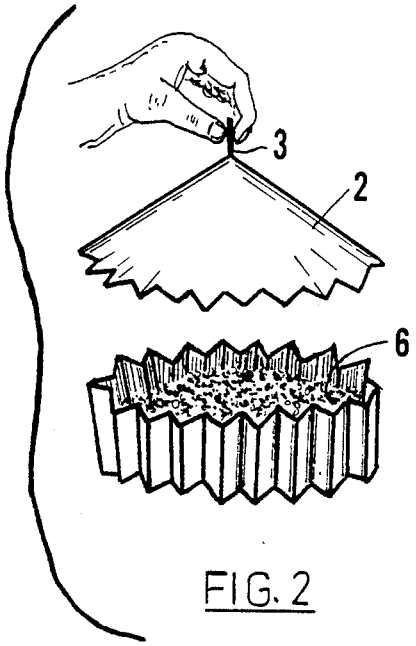
FIG. 2 is a perspective view of the packet after it has been opened.
Figure 3:
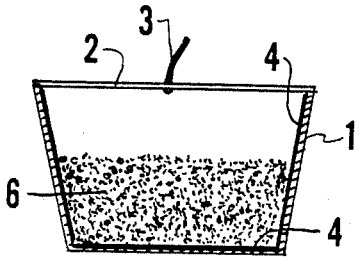
FIG. 3 is a cross sectional view of the packet of FIG. 1 along the line A—A'.

The first embodiment of the invention will be explained with reference to FIGS. 1, 2 and 3. A packet 9 includes a pleated body 1 formed of porous, filter paper, the ground coffee powder 6 and a plastic cover sheet 2. The cover sheet is hermetically sealed to the upper edges of body 1. The cover sheet serves as a seal and to hold in the pleated sides of the packet. The inner surfaces of the body 1 are coated with an air-impervious, edible layer of gelatin 4. Volatile oils contained in the coffee and which contribute to its aroma and taste are thus sealed in by the gelatin layer on the insides and bottom of the packet and by the plastic cover sheet 2. Several of the packets can be stored and sold in a larger plastic container. After the latter is opened to remove a packet, it can be resealed to further preserve the volatile materials.

The user of the invention first pulls out the receptacle of the brewing machine and cleans it of its previous charge. A packet made according to the above described principles is dropped into the receptacle and the tab 3 is pulled to remove the plastic cover. This permits the pleated body 1 to expand against the sides of the receptacle as a result of the folded tension in the pleats and the weight of the coffee powder 6. This expansion minimizes the amount of water which might otherwise seep between the outer surface of the packet and the side of the receptacle. The receptacle is then closed and the cycle started. The flow of hot water melts the gelatin layer 4 which then flows into and is caught by the porous filter paper. The small amount entering the liquid coffee is tasteless and acceptable for human consumption.

In the prior art the following procedures are necessary to charge an automatic brewer:

a. procure, unfold and place a filter in the receptacle;
b. procure, tear open and pour over the filter a premeasured packet of ground coffee.

The present invention combines several of these procedures. The powder pouring step is completely eliminated.

Figure 4:
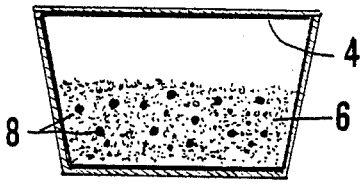
FIG. 4 is a cross sectional view of a packet showing features of a second and third embodiment of the invention.

An embodiment of the invention requiring one less step (the removal of a plastic cover) is shown in FIG. 4. The packet is sealed at the top by a porous paper surface the bottom of which is coated with a gelatin layer 4. In this case the percolating hot water passes through the top layer and melts away the gelatin before it reaches the coffee solids 6. No plastic top seal is required.

Another type of top layer would consist of a cheesecloth impregnated with gelatin. The top layer can also be made of any impervious, hot water-soluble sheet material which has been approved as harmless when consumed.

Figure 5:
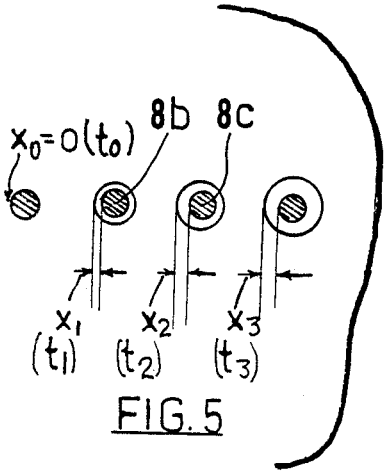
FIG. 5 shows details of construction of timed-release flavoring modules as employed in the third embodiment of the invention.
Figure 6:
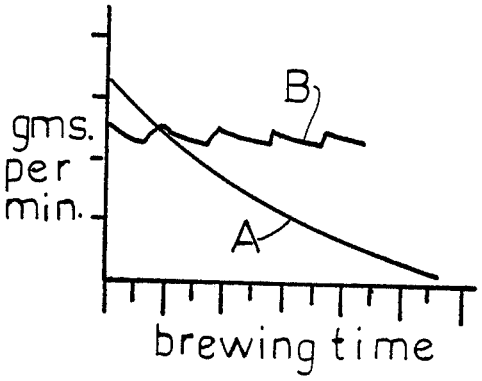
FIG. 6 shows graphs of the timed-release action as compared to simple addition of flavoring.

A third embodiment of the invention is shown in FIGS. 4, 5 and 6. Small spheres 8 made up of gelatin coated flavoring materials are thoroughly mixed with the coffee. The thicknesses $x_0$, $x_1$, $x_2$, etc. of the gelatin coatings are varied to give a timed-release property to the flavoring. The principle of timed-release is well known to the art of orally-administered medical substances but is unique in the concept of coffee brewing. In the present application a certain percentage of the flavoring materials are uncoated and dissolve at once when the hot percolating water is encountered. During the time, $t_0$, required for complete dissolving of the the uncoated particles, the layer $x_1$ which protects the most thinly coated particles also dissolves and the hot water then attacks the **8*b* flavoring particles. The dissolving of the protective layers about all the flavor particles continues until all are exposed and dissolved. The effect is shown in FIG. 6** which is a graph of the dissolving rate vs. the number of cups of coffee made during the brewing cycle. In the smaller brewing machines the dissolving rate of uncoated particles (curve A) would not be important because a new packet would be used for every twelve cups. With the larger machines (using larger packets), the coffee is taken off in twelve cup containers. The more uniform dissolving rate shown by curve B would assure that each container would contain the same amount of flavoring. The timed release of flavoring would also be of use in vending machines where coffee is brewed in small batches from a large packet.

The invention has been described in terms of restaurant brewing machines. A similar packet will also be convenient for use in home coffee makers and will facilitate cleanup.

I claim:

1. A coffee packet for use in the receptacle of a coffee brewing machine comprising:

a. a porous paper outer housing having an approximate cylindrical shape, open top, pleated walls and a flat bottom, said housing being coated on its inside surfaces with an edible, air-impervious, low melting substance;

b. a premeasured quantity of ground coffee solids contained in said housing and resting on and against said coated inside surfaces;

c. an air-impervious circular plastic cover sheet hermetically and resealably joined to said pleated walls at their uppermost periphery such that the joined cover sheet holds the pleated walls under folded tension such that the diameter of the housing is reduced and a hoop stress is created in the pleated walls, the plastic sheet serving in conjunction with the coated inside surfaces as an air tight seal for said coffee solids;

d. a tab firmly attached to the plastic sheet, said tab being capable of freeing the plastic sheet from the top of the pleated wall when pulled;

whereby the coffee brewing machine can be operated as follows:

(i) the receptacle of the machine is opened and the said coffee packet is placed inside;

(ii) the tab is pulled to separate the plastic sheet, thus unsealing the packet and causing the pleated walls, by virtue of their hoop stress, to expand against the sides of the receptacle;

(iii) the receptacle is closed and the coffee brewing machine is started.

2. A coffee packet as described in claim 1 in which said inside surface coating is melted by hot water normally used in the brewing cycle of a coffee brewing machine with the porous paper housing now serving as a filter to prevent coffee grounds and melted coating from entering the prepared coffee liquid.

3. A packet as described in claim 1 containing, in addition to ground coffee solids, flavoring particles having various thicknesses of gelatin coating so as to provide timed-release dissolving properties to match the brewing rate of the coffee solids.

* * * * *